United States Patent [19]

Anderson et al.

[11] Patent Number: 4,966,883

[45] Date of Patent: Oct. 30, 1990

[54] COMPOSITION FOR USE IN THERMALLY SENSITIVE COATINGS AND A THERMALLY SENSITIVE RECORDING MATERIAL

[75] Inventors: Nils T. Anderson, Vancouver, Wash.; Boris J. Katsen, Beaverton, Oreg.

[73] Assignee: James River Graphics, Inc., South Hadley, Mass.

[21] Appl. No.: 232,996

[22] Filed: Aug. 17, 1988

[51] Int. Cl.[5] ..... B41M 5/18

[52] U.S. Cl. ..... 503/208; 427/150; 427/151; 503/209; 503/214; 503/216; 503/217; 503/221; 503/225

[58] Field of Search ..... 427/150–152; 503/208, 209, 216, 217, 225, 214, 221

[56] References Cited

U.S. PATENT DOCUMENTS 4,590,498 5/1986 Yahagi et al. ..... 503/217

FOREIGN PATENT DOCUMENTS 0041994 3/1982 Japan ..... 503/208

*Primary Examiner*—Bruce H. Hess

*Attorney, Agent, or Firm*—Burns, Doane, Swecker & Mathis

[57] ABSTRACT

A composition for use in a thermal-sensitive paper coating and a heat-sensitive recording material utilizing the coating, which composition comprises a phenolic developer, e.g., a traditional low speed phenolic having a melting point greater than 120° C., and a pseudo developer. The pseudo developer is combined with the phenolic developer in an amount effective to provide for the formation of homogenous phase when the composition is melted, which phase further solidifies back to a single crystalline phase when cooled.

15 Claims, 1 Drawing Sheet

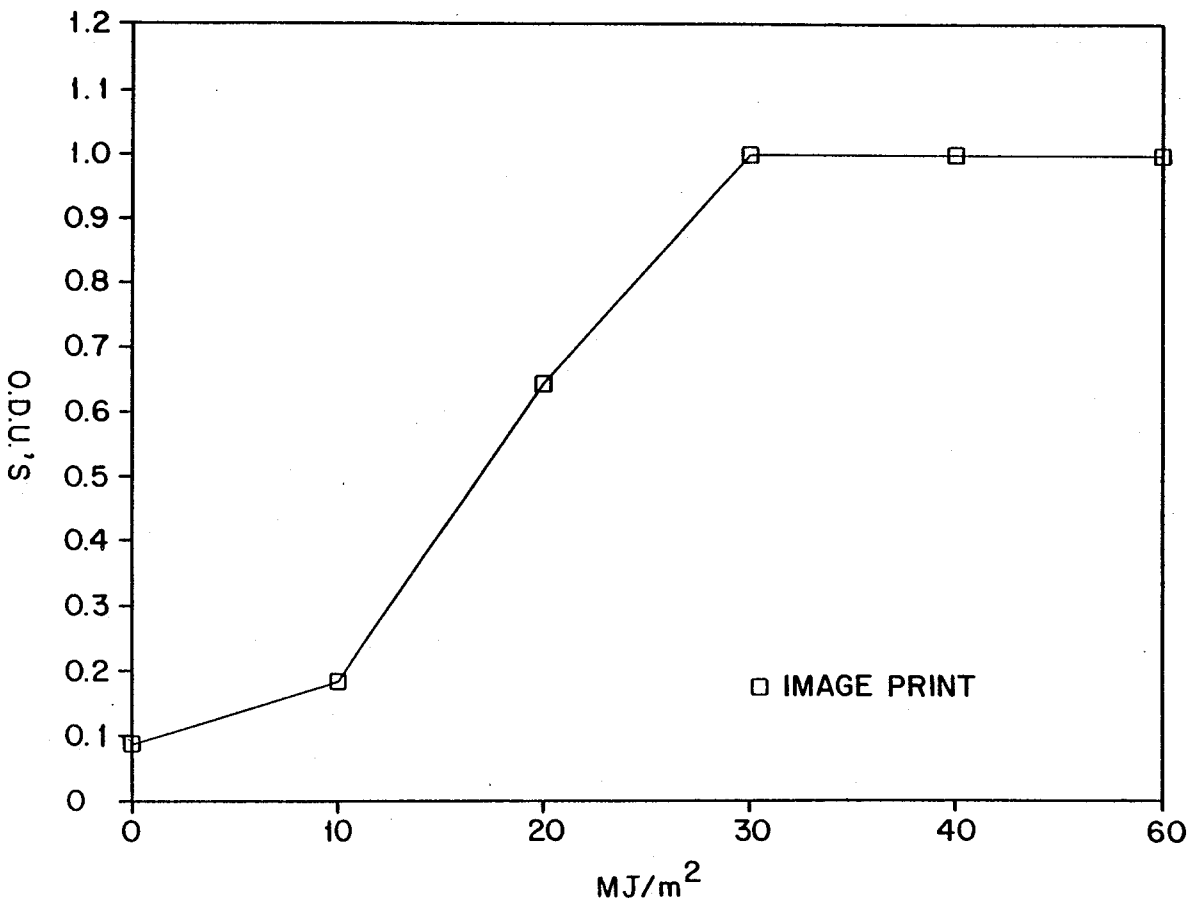
1.2
1.1
1.0
0.9
0.8
0.7
0.6
0.5
0.4
0.3
0.2
0.1
0
O.D.U.'S
0
10
20
30
40
60
MJ/m2
IMAGE PRINT

COMPOSITION FOR USE IN THERMALLY SENSITIVE COATINGS AND A THERMALLY SENSITIVE RECORDING MATERIAL

BACKGROUND OF THE INVENTION

The present invention relates to a composition for use in a thermally sensitive coating, and a thermally sensitive recording material which utilizes the composition.

A thermally sensitive recording material is a recording material which comprises a base or support layer with a thermally sensitive layer on the base which is capable of forming color upon the application of heat. Thermally sensitive material has been used as a recording paper in a wide variety of environments such as facsimiles and other types of modern recorders and printers.

Recently, with the advent of thermal recording technology which allows for high speed recording, for example, through the use of thermal-recording heads having good heat response characteristics, attempts have been made to provide a "high speed" developer which produces highly dense and stable color pictures for use with the high speed recorders. However, as discussed in U.S. Pat. No. 4,399,188, the low color forming temperatures required (70 to 120 C.) for the high speed recorders has prevented the use of traditional developers, such as bisphenol A, which has a melting point of 156° to 158° C. Therefore, the art has turned to lower melting point developers in an effort to solve this problem. But the use of low melting point developers has introduced their own set of problems with regard to sublimation and stability of the produced image.

In addition to the ability to provide an image with the desired color fastness and density within a high speed recording environment, the recording material must also provide resistance to plasticizers, oil, water, and organic solvents.

Attempted solutions for the above problems have lead to the use of additives and fillers within the thermal sensitive layer. For example, U.S. Pat. No. 4,590,499, to Fujimura et al. relates to a thermal sensitive paper in which the thermal sensitive layer can include a stabilizer, a filler, a sensitizer, a wax resistance additive, a water resistance additive, and surface lubricants.

The use of such large amounts of additives, however, introduces other problems. For example, the presence of waxes and lubricants in their normally used concentration makes the final product slippery to the touch. This gives the perception to the consumer that the thermally sensitive material is not of the same quality as regular bond paper.

Furthermore, the use of fillers which possess high oil absorbance values, subject the print head to undesirable abrasion and possible contamination from partially melted components of the thermal sensitive coating.

In addition, the use of other abrasive fillers such as $TiO_2$, fumed silica, or calcined clay, which provide the finished product with whiteness, also cause undesirable abrasion of the print head.

Besides the problems associated with the fillers, the use of waxes and lubricants within the coating material requires a complex system for producing the coating because the waxes and lubricants are generally individually prepared within their own individual dispersions and each of the dispersions are then mixed together with the dispersion containing the developer. Such a system is undesirable both in terms of complexity and cost.

Accordingly, it is an object of the present invention to eliminate the need for large quantities of fillers, lubricants and waxes for thermally sensitive coatings.

Further, it is an object of the present invention to provide a simplified process for providing a thermally sensitive coating for high speed recorders utilizing high melting point developers.

These and further objects will become apparent from the specification and claims that follow.

SUMMARY OF THE INVENTION

In accordance with the foregoing objectives, the present invention relates to a composition useful in thermally sensitive coatings, and a thermally sensitive material utilizing the composition.

The composition of the present invention comprises a phenolic developer and a "pseudo developer". The pseudo developer is a compound whose structure reflects a stereo resemblance to either phenolic developers, such as phenols or hydroxybenzoic acid esters, or leuco dyes and is combined with the phenolic developer in an amount effective to provide for the formation of a homogeneous phase when the composition is melted, which phase further solidifies back to a single crystalline phase when cooled. In a preferred embodiment of the present invention, the phenolic developers are ordinary low speed developers, i.e., having a melting point greater than 120° C.

In yet another aspect of the invention, an antioxidant and/or a natural or synthetic wax may be included within the composition.

Another aspect of the present invention relates to a thermally sensitive material comprising a base layer having a thermally sensitive color forming layer thereon. The color forming layer comprises a leuco dye, a phenolic developer, and a pseudo developer as previously described.

BRIEF DESCRIPTION OF THE DRAWING

The Drawing FIGURE is a graph which illustrates the improved dynamic sensitivity illustrated by Example 5 of the present invention.

DETAILED DESCRIPTION OF THE PREFERRED EMBODIMENTS OF THE INVENTION

The phenolic developer employed within the present invention can include ordinary low speed developers. Such developers, which have a high melting point (e.g., greater than 120° C.), normally do not possess adequate sensitivity to be used in high speed development. Examples of such developers include 4,4'-isopropylidenediphenol (Bisphenol A), 4,4'-dihydroxydiphenyl sulfone, 4,4'-dihydroxydiphenyl sulfide, p-phenylphenol, 4,4'-dihydroxydiphenol, 4,4'-dihydroxymethelenediphenol, various hydroxybenzoic acid esters, 4-hydroxyphthalic acid esters, phthalic acid monoesters, substituted bis (hydroxyphenyl sulfides and sulfones) and 4,4'-methylenecyclohexyldiphenol and other crystalline organic acids having melting points greater than 120° C. Bisphenol A is preferred.

The ability to utilize high melting point phenolic developers within the thermal sensitive materials of the present invention can eliminate undesirable sublimation of the thermal sensitive coating while stabilizing the density of the developed color image.

The pseudo developers of the present invention are those compounds whose structures reflect a stereo resemblance to either the phenolic developers (e.g., the phenols or the hydroxybenzoic acid esters) or the leuco dyes, while, at the same time, providing an enhanced mutual solubility between the phenolic developer and the pseudo developer. The pseudo developers of the present invention also advantageously allow for increased stability of the composition which prevents premature discoloration of the thermal sensitive material.

The preferred pseudo developers are alkyl and sulfur containing biphenols, acetoxyalkyl biphenols, acetoxyalkylphenolphthaleins and the derivatives of phenolphthalein like 2,4-acetylphthalein, various acetylnaphthols and acylaleylphthaleins or mixtures thereof. Diphenyl sulfone and dichlorodiphenyl sulfone are particularly preferred.

Examples of suitable compounds which can be used as pseudo developers are those crystalline phase materials having the following structural formulas:

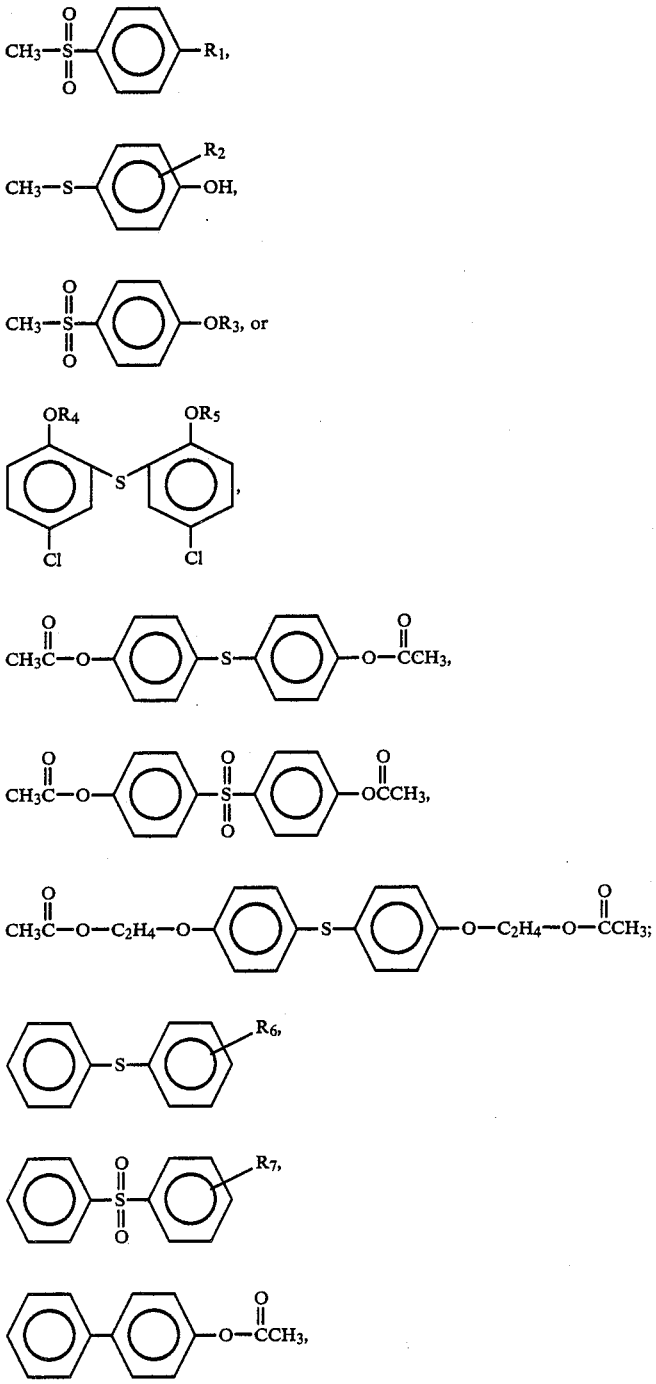

-continued

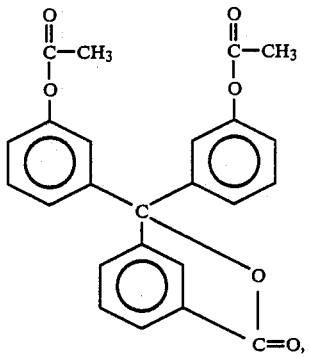

or mixtures thereof, wherein $R_1$–$R_7$ are hydrogen, halogen, alkyl, allyl, aryl or acetyl radical(s). It should be noted that the foregoing list of pseudo developers for practice of the present invention is certainly not intended to be exhaustive, and one skilled in the art can deduce other materials possessing similar action.

In making the composition according to the present invention, the phenolic developer and the pseudo developer are generally dispersed into a binder. The amount of the pseudo developer employed within a dispersion according to the present invention is that effective amount which allows for the formation of a homogenous phase upon melting of the composition and which further solidifies back into a single phase crystalline form when the composition is cooled.

With regard to suitable binders, many different conventional binders may be employed in the present invention. Suitable examples include polyvinyl alcohol (PVA), water soluble and/or oxidized starches, water soluble styrene maleic anhydride copolymers or salts thereof; diisobutylene maleic anhydride copolymers; casein; or mixtures thereof. When a small amount of alkaline binder, e.g., an ammonium, amino or alkaline metal salt of styrene maleic anhydride copolymer is used in conjunction with fully hydrolyzed PVA, image stability is enhanced even when the material is exposed to elevated temperature and humidity. Therefore, PVA, or a combination of PVA with an alkaline binder, is most preferred for use in the present invention.

The composition can also include, if desired, additives, such as antioxidants and natural or synthetic waxes. The amount of such additives employed within the present invention is that which allows for the composition to cool to a single crystalline form after being melted. Examples of suitable antioxidants are 2,2'methylenebis(4-ethyl-6-tert-butylphenol (Cyanox 425 Antioxidant from American Cyanimid), 2-hydroxyl-4-n-octoxybenzophenol (Cyasorb UV 531 Light Stabilizer), 4,4'-thiobis(6-tert-butyl-n-cresol) or mixtures thereof. The Cyanox 425 compound is most preferred.

The waxes employed within the present invention preferably have a melting point of 70° 105° C. Fatty acid amide type waxes such as Eurecoamide (m.p. 88° C.) from Humco Chemical Division of Witco Corp. and stearamide (m.p. 99° C.) as well as polyethylene waxes are most preferred.

The mixing of the dispersion can occur in standard high shear mixers of the Kady Mill type with any subsequent grinding occurring within a pressurized bead mill.

The leuco dyes which are utilized within the thermal sensitive coatings of the present invention can be conventional leuco dyes and may include phthalide or fluoran type leuco compounds such as Crystal Violet Lactone, 3-diethylamino-6-methyl-7-anilinofluoran, 3-dibutylamino-6-methyl-7-anilinofluoran, 3-diethylamino-7-chloroanilinofluoran, 3-diethylamino-7-fluroranilinofluoran or mixtures thereof. The preferred dye is 3-diethylamino-6-methyl-7-anilinofluoran.

A leuco dye concentration within the dye dispersion of from 20–30 weight percent is preferred, with about 25 weight percent being most preferred.

The leuco dye is ground in a dye dispersion separate from the dispersion of the inventive component. Any known suitable solution can be used in formulating the dye dispersion, with about a 5% solution of polyvinyl alcohol (PVA-325 from Air Products) being most preferred.

A thermally sensitive material of the present invention includes a base and a thermally sensitive coating layer thereon. The base can be a paper or plastic carrier with MG grade paper being preferred. The coating layer comprises a mixture of the dispersion of the inventive component with a dispersion containing a leuco dye.

The two dispersions are mixed in amounts suitable to maintain a single crystalline phase when melted and subsequently cooled. The coating can also contain an effective amount of a third dispersion of calcium carbonate to increase whiteness of the final product.

The amount of the thermally sensitive coating layer applied to the base is preferably from about 6 to about 9 $g/m^2$, with about 8 $g/m^2$ being most preferred.

The coating layer can be applied by means known in the art such as rod coating, blade coating, air knife coating, precision nip coating, and other conventional means known to the coating art.

Utilization of the present invention can substantially reduce, or completely eliminate, the need for many of the fillers, waxes and lubricants required within the prior art. The reduction or elimination of such additives provides many advantages including:

(1) The problems regarding abrasion of the print head, and contamination of the print head due to partially melted components can be greatly reduced or even eliminated by substantially decreasing, or eliminating, the amount of filler with high oil absorbance values used within the thermally sensitive coating;

(2) The abrasion problem is also improved by decreasing the excessive amounts of abrasive fillers such as $TiO_2$, etc. Further, the present invention accomplishes this advantage while still increasing the mixture stability;

The slippery feel associated with current (3) The slippery feel associated with current thermal paper may be eliminated by the reduction (or elimination) in the amounts of waxes and lubricants employed. This allows for increased consumer satisfaction because the thermally sensitive material of the present invention can have the aesthetics of bond paper;

(4) The processing of the coating can be greatly simplified. More specifically, by decreasing the amounts of fillers, waxes and lubricants employed, the present invention eliminates the need to provide wax and lubricant emulsions which are separate from the developer dispersion. This simplification also eliminates the use of some surfactants, emulsions, stabilizers, and various polymers which are currently used as protective colloids, but which are unnecessary within the present invention.

In order to further illustrate the present invention and the advantages associated therewith, the following specific examples are given, it being understood that same are intended only as illustrative and in nowise limitative. All parts and percentages in the examples and the remainder of the specification are by weight unless otherwise specified.

EXAMPLE 1

Preparation of Dispersion A 1540 g of a 10% polyvinyl alcohol solution were poured into a high shear laboratory mixer and 212 g of thiodiphenol diacetate, 91 g of thiodiphenol, 122 g of diphenyl sulfone, 35 g of stearamide and 5 g of an antioxidant (2,2'methylenebis(4-ethyl)-6-tert-butylphenol) were slowly charged into the same vessel and dispersed for an hour at a temperature close to about 50° C. The resulting dispersion was ground to an average particle size of 5–7 microns.

Preparation of Dispersion B 3-dibutylamino-6-methyl-7-anilinofluoran (ODB-2 from Yamamoto) was ground in a 5% solution of polyvinyl alcohol (PVA-325 from Air Products) to a dye concentration of about 25%.

Preparation of Dispersion C

50% dispersion of calcium carbonate was prepared by grinding Microwhite 25 grade of carbonate in a 5% solution of PVA-325. The Microwhite 25 was obtained from Sylacauga Co., Alabama. (Commercially available slurry carbonates might also be employed if so desired.)

Preparation of Final Coating

To 200 g of dispersion A, 36 g of dispersion C and 16 g of dispersion B were added and the resulting coating composition was coated onto the surface of smooth paper to give a thermal paper which was printed on a printer having a printhead furnished by Gulton Industries.

The following optical densities were obtained at 10, 20, 30, 40, and 60 MJ/sq.m. Correspondingly: 0.27, 0.68, 0.89, 0.89, 0.89 ODU (Optical Density Units) image densities were obtained.

The same paper was printed on a Canon Fax-410 facsimile device and gave an optical density of a single dot as 0.92 ODU, when measured on a MacBeth PCM II print contrast meter. All of the samples prepared from the formulation described above were of high whiteness and had an optical density of the background of about 0.05 ODU. The weight of the coating in the above example was around 9 g per sq.m.

The same paper was tested using an accelerated printhead abrasivity method. In this method an Adams Wetrub tester is used. The subject paper is rotated against a stationary brass shim stock under a given load and for a predetermined length of time. Scratches produced on the surface of the shim stock simulate scratches produced on a thermal printhead. By comparing the optical reflectivity of the shim stock before and after contact with the subject thermal paper it is possible to determine an abrasion factor for the paper. Papers which are known to cause premature printhead failure show abrasion factors greater than 0.35. Commercial papers which show the least wear on a printhead give abrasion factors less than 0.20, with moderate, but acceptable papers, showing values between 0.20 and 0.35. The paper of Example 1 gave an abrasion factor of 0.14. The papers of Examples 2, 3, 4, and 5 below, all examples of the present invention, gave factors as follows: 0.13, 0.12, 0.15 and 0.15, respectively.

EXAMPLE 2

Dispersion A in this example was made the same way as dispersion A in Example 1, but consisted of 1540 g of a 10% PVA-325 solution, 256 g of diphenyl sulfone, 154 g of bisphenol A, 50 g of stearamide and 5 g of the antioxidant used in the Example 1.

Preparation of Final Coating

To 200 g of dispersion A, 16 g of a 50% dispersion of Microwhite 25 grade calcium carbonate were added and 9.5 g of a 50% dispersion of 3-dibutylamino-6-methyl-7-fluoro anilinofluoran (TG-21 dye dispersion available from Nihon Kayaku Co.) were added and mixed under mild agitation. The resulting mixture was deaerated under vacuum and applied to the surface of the smooth paper.

The coated paper was calendared to a Parker surf print smoothness of 1.3–1.5 and printed on a Hobart-18 VP scale label printer to give an optical density of a single dot of 1.00 ODU's at 1.2 and 1.3 watts per dot.

EXAMPLE 3

Bisphenol A was used again as the color developer but dichlorodiphenyl sulfone was used as the pseudo developer instead of diphenyl sulfone. Dispersion A consisted of the following components which formed a homogeneous single phase melt when heat was applied.

| Dispersion A | |
|---|---|
| 10% PVA solution | 1540 g |
| Thiodiphenol diacetate | 33 g |
| Bisphenol A | 132 g |
| Stearamide | 49 g |
| Dichlorodiphenyl sulfone | 246 g |
| Antioxidant (as in Examples 2 and 3) | 5.0 g |

This dispersion was ground with the use of a pressurized horizontal mill to an average particle size of 5–7 microns.

200 g of dispersion A were mixed with 36 g of 25% dispersion of the black dye —ODB—2 and 18 g of the 50% dispersion of calcium carbonate.

The resulting thermal coating was extremely white and when coated on MG grade paper (or machine glazed paper), calendered to 1.3–1.5 μ and printed on a Canon Fax-410 machine. The optical density of a single dot, again measured on a MacBeth PCM 11 print contrast meter, was 0.85 at the background level of 0.05–0.06 ODU's.

EXAMPLE 4

Dispersion A of this example consists of the same ingredients as in Example 3, but the ratio of the components is different.

| | |
|---|---|
| PVA-325 10% solution | 1540 g |
| Thiodiphenol diacetate | 254 g |
| Bisphenol A | 137 g |
| Dichlorodiphenyl sulfone | 58 g |
| Stearamide | 10 g |
| Antioxidant (as in Ex. 1, 2 and 3) | 5 g |

The resulting dispersion, after treatment in the high shear mixer was ground in a horizontal mill (Eiger mill with zirconium oxide beads of 0.8 to 1.2 mm in diameter). The average particle size was about 5–7 μ. 200 g of the formulation above were mixed with 9.5 g of the 50% dye dispersion (TG-21) and 18 g of calcium carbonate dispersion (50% Microwhite 25 in 5% PVA-325). The resulting mixture was extremely white for more than 24 hours and after deaeration was coated on the surface of a smooth paper to give an optical density of a single dot of 0.854, when printed on a Group III Canon Fax-410.

EXAMPLE 5

Dispersion A of this example is the same as that of Example 4. The resulting dispersion, after treatment in the high shear mixer was ground in a horizontal mill (Eiger mill with zirconium oxide beads of 0.8 to 1.2 mm in diameter). The average particle size was about 5–7. 200 g of the formulation above were mixed with 9.5 g of the 50% dye dispersion (TG-21) and 18 g of calcium carbonate dispersion (50% microwhite 25 in 5% PVA-325). The resulting mixture was extremely white for more than 24 hours.

When printed on Riegel Paper the optical densities illustrated within the Drawing Figure were obtained at 0, 10, 20, 30, 40, and 60 $MJ/m^2$.

All of the above examples demonstrate that high sensitivity is achieved with the use of developers considered as incapable of giving such sensitivity by the various sources (see, for example, U.S. Pat. No. 4,399,188). However, when fortified by the pseudo developer of the present invention, common developers could be used, and in relatively small quantities, to produce thermal products which have a high performance level. The materials of the present invention are compatible with the Group III facsimile machines, scale label printers and other types of thermal printers.

Further, when the ingredients of the present invention are combined in a manner that results in good compatibility and total solubility of the melted state without any phase separation, the resulting mixtures do not require application of the energies greater than is used for the developers of choice, like described in U.S. 4,399,188.

In the Table 1 below are the results of measurements done on a Perkin-Elmer differential scanning calorimeter, recording the energies required to complete full phase transformation for the formulations of the present invention as exemplified by Examples 1–4 and for a comparative material in accordance with U.S. Pat. No. 4,399,188.

TABLE 1

| | Formulation of Heat of Fusion Cal/Gram | Melting Range Degrees C. | Peak Melt. Range, Degrees C. |
|---|---|---|---|
| Example 1 | 24.1 | 69.3–84.5 | 73 |
| Example 2 | 15.0 | 78.4–89.8 | 82 |
| Example 3 | 6.0 | 70.5–92.2 | 78 |
| Example 4 | 19.3 | 74.1–82.8 | 77 |
| U.S. Pat. No. 4,399,188 | 28.3 | 106–110 | 97.6 |

As illustrated by the data in Table 1, the preferred heat of fusion for the formulation is from greater than 0 to about 25 cal/g, with a preferred melting range of 7095° C. These ranges regarding the heat of fusion and the melting range can be used for determining an effective formulation within the present invention. Thus, one of ordinary skill could effectively and easily formulate compositions according to the present invention upon considering the foregoing characteristics.

Furthermore, the lower level of energy required for phase transformation for the examples of the present invention illustrates that one may successfully use common developers, i.e., having a melting point well above 120° C., in relatively small concentrations (18.6% to about 33% in the dry coating). As a result, high mixture stability is achieved and the coatings are white for a prolonged period of time, thus simplifying the manufacturing process.

While this invention has been described in terms of various preferred embodiments, the skilled artisan will appreciate that various modifications, substitutes, omissions and changes may be made without departing from the spirit thereof. Accordingly, it is intended that the scope of the present invention be limited solely by the scope of the following claims including equivalents thereof thereof. Accordingly, it is intended that the scope of the present invention be limited solely by the scope of the following claims including equivalents thereof.

What is claimed is:

1. A heat-sensitive recording material comprising a heat-sensitive color forming layer on a base; said color forming layer comprising a leuco dye, a phenolic developer, and a pseudo developer comprising diphenyl sulfone, halogenated diphenyl sulfones, or mixtures thereof, where the pseudo developer is present in an amount effective to provide for the formation of a homogeneous phase which is capable of solidifying to a single crystalline phase when the color forming layer is melted and cooled.

2. The recording material of claim 1, wherein the color forming layer further comprises an antioxidant in an amount which is effective to provide a single crystalline phase when the composition is melted and cooled.

3. The recording material of claim 2, wherein the color forming layer further comprises a natural or synthetic wax in an amount which is effective to provide of the formation of a homogenous phase which is capable of solidifying to a single crystalline phase when the composition is melted and cooled.

4. The recording medium of claim 3 wherein the wax has a melting point of 70–105° C.

5. The recording medium of claim 4 wherein the wax comprises Eurecoamide, stearamide, polyethylene waxes or mixtures thereof.

6. The composition of claim 5 wherein the wax is Eurecoamide.

7. The recording medium of claim 1, wherein the phenolic developer has a melting point greater than 120° C.

8. The recording medium of claim 7, wherein the phenolic developer comprises 4,4'-isopropylidenediphenol, 4,4'-dihydroxydiphenyl sulfone, 4,4'-dihydroxydiphenyl sulfide, p-phenylphenol, 4,4'-dihydroxydiphenol, 4,4'-dihydroxymethelenediphenol, 4-hydroxyphthalic acid esters, 4,4'-methylenecyclohexyldiphenol or mixtures thereof.

9. The recording medium of claim 8 wherein the phenolic developer is 4-4'-isopropylidenediphenol.

10. The recording medium of claim 9 wherein the pseudo developer is diphenyl sulfone, dichlorodiphenyl sulfone or mixtures thereof.

11. The recording medium of claim 2 wherein the antioxidant comprises 2,2'methylenebis (4-ethyl-6tert-butylphenol), 2-hydroxyl-4-n-octoxybenzophenol, 4,4'-thiobis(6-tert-butyl-n-cresol) or mixtures thereof.

12. The recording medium of claim 11 wherein the antioxidant is 2,2'methylenebis (4-ethyl-6-tert-butylphenol).

13. The recording medium of claim 1 wherein the pseudo developer further comprises a crystalline phase material of the following structural formula:

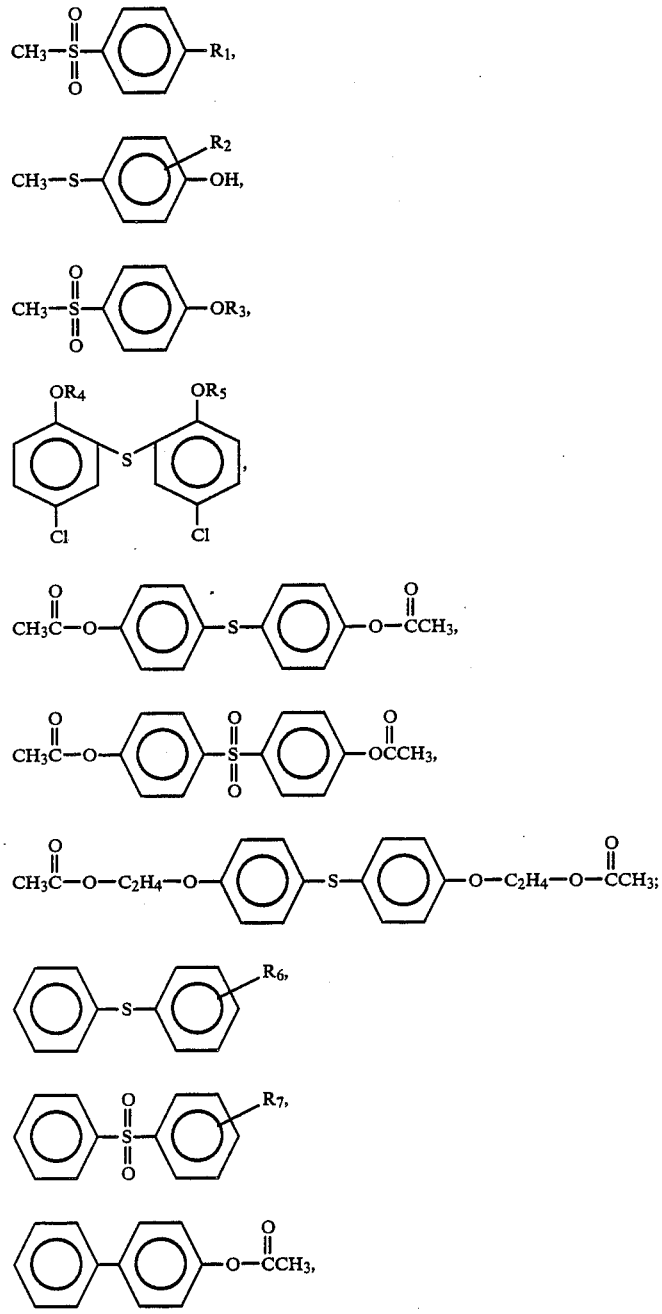

-continued

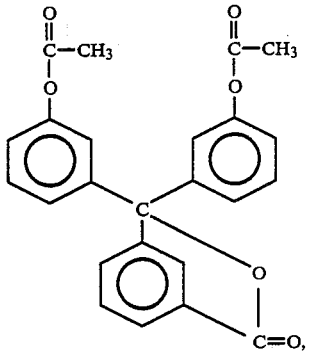

wherein $R_1$–$R_7$ are hydrogen, halogen, alkyl, allyl, aryl or acetyl radicals.

14. The recording medium of claim 1 wherein the pseudo developer is diphenyl sulfone, dichlorodiphenyl sulfone or mixtures thereof. 6-tert-butylphenol).

15. The recording medium of claim 1 wherein the leuco dye comprises Crystal Violet Lactone, 3-diethylamino-6-methyl-7-anilinofluoran, 3-dibutylamino-6-methyl-7-anilinofluoran, 3-diethylamino-7-chloroanilinofluoran, 3-diethylamino-7-fluroranilinofluoran or mixtures thereof.

* * * * *